US010077904B2

(12) United States Patent
Grant

(10) Patent No.: US 10,077,904 B2
(45) Date of Patent: Sep. 18, 2018

(54) WOOD PELLET BURNER ASSEMBLY

(71) Applicant: Stephen William John Grant, Dublin (IE)

(72) Inventor: Stephen William John Grant, Dublin (IE)

( * ) Notice: Subject to any disclaimer, the term of this patent is extended or adjusted under 35 U.S.C. 154(b) by 660 days.

(21) Appl. No.: 14/399,312

(22) PCT Filed: May 7, 2013

(86) PCT No.: PCT/EP2013/059533
§ 371 (c)(1),
(2) Date: Nov. 6, 2014

(87) PCT Pub. No.: WO2013/167619
PCT Pub. Date: Nov. 14, 2013

(65) Prior Publication Data

US 2015/0122241 A1 May 7, 2015

(30) Foreign Application Priority Data

May 8, 2012 (GB) ..... 1207976.0

(51) Int. Cl.
*F24B 5/02* (2006.01)
*F24B 1/02* (2006.01)
(Continued)

(52) U.S. Cl.
CPC ..... *F24B 1/026* (2013.01); *F23B 50/12* (2013.01); *F23B 60/02* (2013.01); *F24B 5/023* (2013.01);
(Continued)

(58) Field of Classification Search
CPC ..... F24B 13/006; F24B 1/026; F24B 5/023; F24B 9/00; F24B 13/02; F03B 50/12; F03B 60/12
(Continued)

(56) References Cited

U.S. PATENT DOCUMENTS 3,667,448 A 6/1972 Dorian
2007/0186920 A1 8/2007 Wisener
(Continued)

FOREIGN PATENT DOCUMENTS

CN 2033094 U 2/1989
EP 1568948 A2 * 8/2005 ..... F23B 1/26
(Continued)

OTHER PUBLICATIONS

Abstract of EP 1568948 A2.*
International Search Report of PCT/EP2013/059533, dated Nov. 25, 2013.

*Primary Examiner* — Alfred Basichas
(74) *Attorney, Agent, or Firm* — Collard & Roe, P.C.

(57) ABSTRACT

There is provided a wood pellet burner assembly for a wood pellet boiler, not shown. There is a fixed and easily removable fuel apertured grate mounted above and spaced apart from a base wall forming part of a main support enclosure. A movable scraper subassembly carrying an apertured flame tube is provided which can be moved in and out of the main support enclosure to perform a scraping action on the fixed fuel apertured grate to deliver ash and clinker which have not fallen through the grate during combustion off the grate out of the main support enclosure. This cleaning operation can be carried out at suitable preset time intervals.

15 Claims, 14 Drawing Sheets

(51) Int. Cl.

| | |
|---|---|
| ***F23B 50/12*** | (2006.01) |
| ***F23B 60/02*** | (2006.01) |
| ***F24B 9/00*** | (2006.01) |
| ***F24B 13/00*** | (2006.01) |
| ***F24B 13/02*** | (2006.01) |

(52) U.S. Cl.
CPC ..... *F24B 9/00* (2013.01); *F24B 13/006* (2013.01); *F24B 13/02* (2013.01)

(58) Field of Classification Search
USPC ..... 126/77, 161
See application file for complete search history.

(56) References Cited

U.S. PATENT DOCUMENTS

| | | | | |
|---|---|---|---|---|
| 2007/0215021 | A1* | 9/2007 | Krumrei | F23B 1/24 110/341 |
| 2008/0156312 | A1* | 7/2008 | Graham | F23B 50/02 126/161 |
| 2009/0025654 | A1 | 1/2009 | Hardy | |
| 2011/0136066 | A1 | 6/2011 | Geselle et al. | |

FOREIGN PATENT DOCUMENTS

| | | | |
|---|---|---|---|
| JP | 57-62357 | A | 4/1982 |
| JP | 63-247527 | A | 10/1988 |
| WO | 01/23808 | A1 | 4/2001 |

* cited by examiner

WOOD PELLET BURNER ASSEMBLY

CROSS REFERENCE TO RELATED APPLICATIONS

This application is the National Stage of PCT/EP2013/059533 filed on May 7, 2013, which claims priority under 35 U.S.C. § 119 of British Application No. 1207976.0 filed on May 8, 2012, the disclosures of which are incorporated by reference.

INTRODUCTION

This invention relates a wood pellet boiler, the wood pellet burner assembly being of the type comprising: a main support enclosure for mounting within the wood pellet boiler and for supporting the wood pellet boiler assembly; an enclosed air chamber fed with combustion air from a burner fan; a brazier for reception of wood pellets and a fuel igniter, the brazier and the fuel igniter being housed within the enclosed air chamber.

The invention also relates to any granular fuel burning boiler and a burner therefor. However, since most of the granular fuel used in such boilers and particularly in domestic boilers are wood pellets, for convenience throughout the specification reference has been made almost exclusively to wood pellets and burners therefor.

A considerable amount of the pertinent prior art in respect of this technology is disclosed in various inventions the subject of patent applications and patents designating the present inventor as the inventor.

A comprehensive search was carried out in respect of the co-pending U.K. patent application number 120 7976 from which priority is claimed for the present invention which discloses the following specifications. None of the specifications revealed were deemed to be of any relevance and were all deemed as indicating technological background and/or state-of-the-art. Indeed we submit are of considerably less relevance to the present invention than the various inventions already referred to, filed in the name of Alley Enterprises Ltd in which the present applicant is named as inventor. The following is a brief summary of the disclosure of these patent specifications.

US 2007/0186920 A1 (Wisener) this specification is of relatively little importance beyond disclosing the problem in relation to the build-up of residue and the need for manual cleaning. It further discloses a removable burner unit.

WO01/23808 A1 (Buckner) again discloses a removable burner unit however of considerably different construction to that of the present invention and indeed does not provide a cleaning function per se.

CN 2033094 U (Gongxing Galvanized Iron Shop) discloses a totally different type of dual fuel firebox. It does show a removable grate but little else of relevance.

JP63247527 A (Ishikawajima Harima Heavy Ind.) this patent specification discloses the use of some form of push to remove waste material from a grate or other support surface. Again this is of limited relevance if any JP570623657 A (Toshiba Denki Kigu KK) again simply discloses a removable fuel burner and does not disclose anything not already conceded in this specification and in the other prior art.

US 2009/0025654A1 (Hardy) generally relates to a combustion air distribution system within a boiler and discloses an elaborate arrangement of stirrer shaft for combustion air and it is again of little or no relevance to the present invention.

U.S. Pat. No. 3,667,448 (Dorian) discloses a portable brazier for cooking and barbecuing foods and discloses a manual scraper for distribution of ashes and other residue to a removable pan. The purpose of this scraper being entirely different to that of the scraper used in the present invention.

In general what can be stated about all the prior art revealed to date is that one would expect that there will be many situations and constructions of brazier where the fuel supporting great forming part of the brazier will be removable as indeed, for example, it is removable in any open fire. What clearly has not been shown is any constructions similar to that described herein.

One of the major problems with such granular fuel burning boilers is the need to handle the residual ash and clinker after combustion. Since, as stated already, most of the granular fuel is in fact wood pellets which contain impurities and what is effectively sand which is ingested into the bark of the living tree. When it burns, the ash content is made up of relatively soft combustion products almost pure carbon dust and what is a vitrified clinker somewhat similar to glass. This vitrified clinker comprises somewhat between 1% and 2% of the weight of the ash which in turn forms somewhat of the order of 0.5% of the fuel. Accordingly it has a relatively small amount of vitrified clinker that is formed, however, it is been found to be a serious issue because it tends to form over the apertures in the brazier which in turn reduces the effectiveness of the combustion process. The conventional way of removing the combustion products from the brazier is to move the base, namely the grate of the brazier away from the sidewalls to allow the combustion products to fall out of the brazier. The problem is that the vitrified clinker does not fall through the brazier and eventually builds up in it. The present invention is directed towards overcoming this problem.

A further problem that arises with wood pellet boilers generally is that when they are used in domestic situations where the boiler has to be mounted within the building, or living quarters thereof, rather than in, for example, an outhouse separate from the main building there are space considerations. There is a clear need for a relatively small overall assembly of wood pellet boiler and its burner assembly. This problem is exacerbated in small living units such as one or two bedroomed apartments. Accordingly, there is a need for a very efficient and compact burner assembly for such boilers. The present invention is directed towards providing a solution to this problem.

STATEMENTS OF THE INVENTION

According to the invention there is provided a wood pellet burner assembly for a wood pellet boiler, the wood pellet burner assembly being of the type comprising:

- a main support enclosure for the wood pellet burner assembly and for mounting it within the wood pellet boiler, the main support enclosure providing an enclosed air chamber fed with combustion air from a burner fan and having a combustion gas outlet into the wood pellet boiler; and
- a brazier for reception of wood pellets and a fuel igniter, both being housed within the enclosed air chamber;

characterised in that the brazier and associated equipment comprises:

a fixed fuel supporting apertured grate mounted above and spaced apart from a base wall forming part of the main support enclosure; and a flame tube having upstanding apertured sidewalls, and in which there is further provided:

a movable scraper sub-assembly for traversing substantially all of the fixed fuel supporting apertured grate for delivery of clinker and residual ash on the fixed fuel supporting apertured grate off the fixed fuel supporting apertured grate and out through a scraper discharge outlet in the enclosed air chamber during a cleaning operation.

This invention has considerable advantages in that the grate is maintained fixed and the scraping is carried out in a positive manner delivering clinker and ash outside the wood pellet burner assembly. The cleaning operation can now be carried out at any desired intervals of time such as for example a preset time of operation or indeed each time the wood pellet burner assembly is restarted after some fixed preset rest interval.

In one embodiment of the invention the base wall has an ash discharge opening and an associated ash discharge closure door and in which there is provided an actuator for the ash discharge closure door operatively connected to the movable scraper sub-assembly whereby on moving the scraper sub-assembly the ash discharge closure is opened. The advantage of this is that there is no need to provide an ash pan within the wood pellet boiler assembly and accordingly the spacing between the grate and the base wall can be kept to a minimum, further reducing the size of the boiler itself. Since the ash and clinker which has fallen through the fixed grate during normal operations is removed regularly there is a further reduction in space requirements.

In another embodiment of the invention a lower portion of the flame tube is movable across the fixed fuel supporting apertured grate to provide part of the scraper sub-assembly. The advantage of this is that there is no need to provide any separate scraper and additionally the flame tube which is of relatively robust construction will operate very successfully. In another embodiment all the flame tube is movable across the fixed fuel supporting apertured grate to provide part of the scraper sub-assembly. This latter manner of carrying out the invention is particularly suitable for use with wood pellet boilers where space requirements are critical. Further, the use of the whole portion of the flame tube ensures that there is a considerable amount of weight bearing down on the fixed grate to ensure considerable abrasion.

Clearly, any such wood pellet burner assembly must of its very nature for efficient combustion have an enclosed air chamber with an exhaust outlet into the body of the wood pellet boiler itself. For greater efficiency in one embodiment of the invention the enclosed air chamber comprises two separate air chambers namely a primary air chamber and a secondary air chamber, containing respectively the movable flame tube and a fixed flame tube communicating with the movable flame tube.

A particularly suitable construction of the movable scraper sub-assembly is provided which comprises a separate support framework including a top plate bridging two depending apertured side plates and an end closure plate for the primary air chamber, the movable flame tube depending from the top plate.

In a further embodiment of the invention a flame tube is fixed within the enclosed air chamber and which carries a pair of spaced apart transfer apertures, namely a proximal aperture and a distal aperture, each being closed in operating conditions by respective proximal and distal closures; and in which the movable scraper sub-assembly comprises a transversely arranged scraper blade. This allows for various types of scraper sub-assembly to be provided and has the advantage of a totally fixed grate and its flame tube. In one modification of this embodiment of the invention the scraper blade forms the proximal aperture closure. This results in a saving of costs and space.

In a modification of this latter embodiment the distal aperture closure is formed by a pivotally mounted distal aperture closure on the flame tube. In this modified embodiment the distal aperture closure is opened by the scraper blade and closed by a link mechanism connected to the scraper blade. The advantage of these two embodiments is that the former provides an easy way of providing a distal aperture closure and the latter ensures that in certain instances where a positive closure is required that it may be easily obtained.

It is envisaged that with any of the embodiments described above the movable scraper sub-assembly mounts an additional auxiliary scraping device in a position rearwardly outside the brazier with respect to its initial movement during a cleaning operation. The provision of additional scraping and abrading means is particularly useful as it will ensure that the fixed apertured grate is always well cleaned.

Such an auxiliary scraping device may be a scraping blade and/or a brush which may or may not be spring biased against the fixed fuel supporting apertured grate. In certain instances of relatively heavy use it may be necessary to provide additional scraping action and these embodiments easily provide that.

In accordance with one embodiment of the invention in the main support enclosure comprises:

a front wall for mounting on the exterior of the wood pellet boiler;

two sidewalls;

a top wall mounting the fixed flame tube;

the base wall;

a rear wall having a scraper discharge outlet spaced apart from and above the base wall through which the scraper sub-assembly moves, the end closure plate carrying a cover plate to provide the ash discharge closure door whereby on the movable flame tube progressing across the fixed fuel supporting apertured grate the ash discharge opening is exposed.

In a particularly suitable embodiments of the invention the fixed fuel supporting apertured grate is removably mounted on one of the sidewalls. This ensures that the grate can be easily removed during standard maintenance and cleaning. Since almost certainly the wood pellet boiler will have a removable ash pan then on the ash pan being removed it will be convenient to also remove the fixed fuel apertured grate.

BRIEF DESCRIPTION OF THE DRAWINGS

The invention will be more clearly understood by the following description of some embodiments thereof, given by way of example only with reference to the accompanying drawings, in which.

DETAILED DESCRIPTION OF PREFERRED EMBODIMENTS

Figure 1:
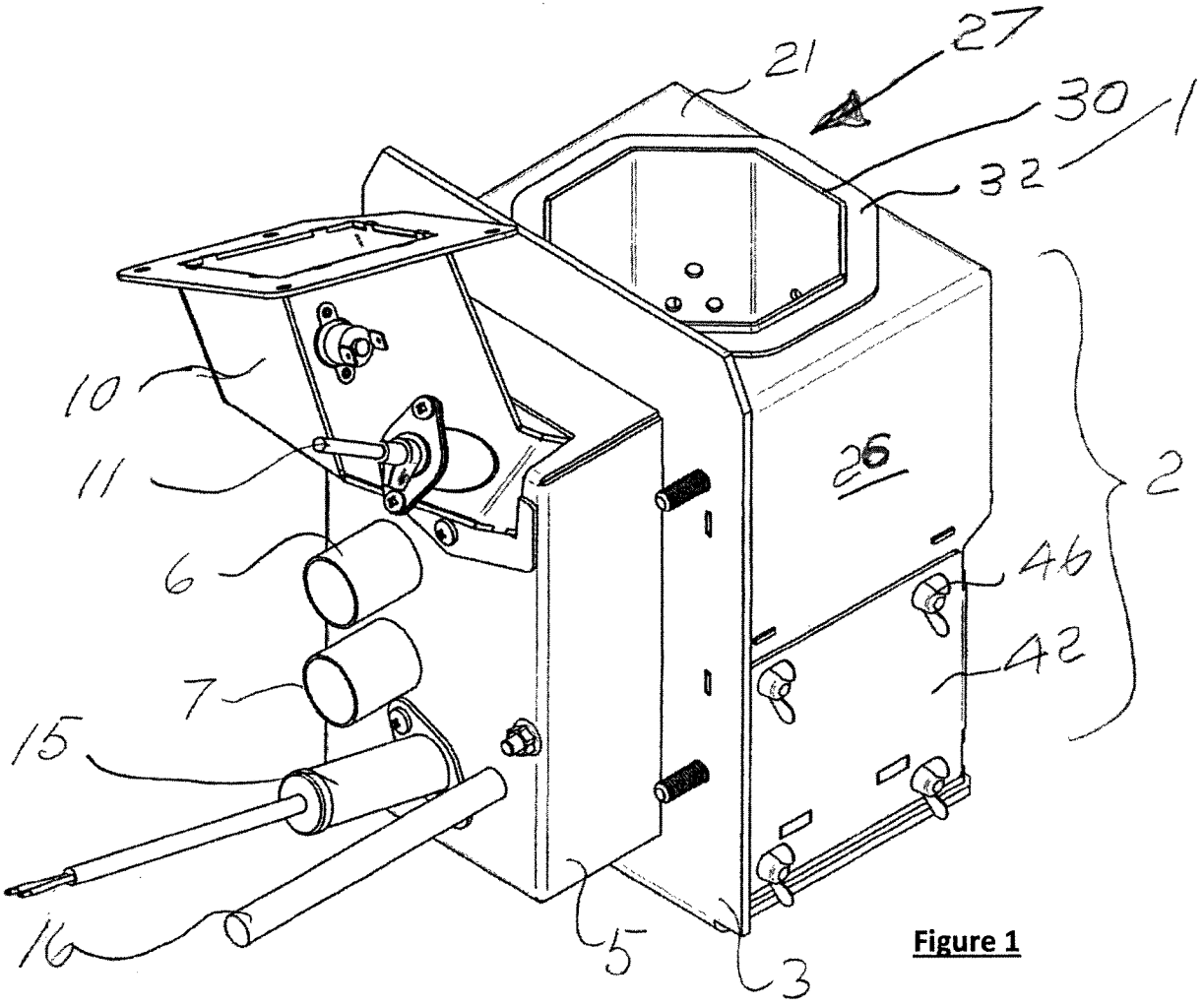
FIG. 1 is a front perspective view of a wood pellet burner assembly according to the invention in its operative position.

Referring to FIGS. 1 to 9 of the drawings and initially more particularly to FIGS. 1 to 5, there is provided a wood pellet burner assembly for a wood pellet boiler, indicated generally by the reference numeral 1. The wood pellet boiler is not illustrated. It is a standard enclosed granular fuel burning boiler and indeed the invention is concerned with any wood pellet boiler. The wood pellet burner assembly 1 comprises a main support enclosure 2 for removably mounting within a wood pellet boiler. The main support enclosure 2 is mounted by means of a front wall 3 forming in effect a mounting plate which in turn is part of the main support enclosure 2. There is illustrated a plenum chamber 5 on which in operation there is mounted a modulating fan, not shown, only an inlet 6 and outlet 7 for such a fan is illustrated. There is also illustrated a wood pellet delivery chute 10 mounting a photocell 11 and ignition element and igniter 15 again not illustrated in any detail as all are of conventional construction. There is also shown in FIG. 1 an actuating con rod 16. The actuating con rod 16 forms part of a linear actuator for use with a movable flame tube as will be described hereinafter. Again any form of actuator, as will be appreciated, could be used such as a manually operated one.

The main support enclosure 2 comprises the front wall 3, a top wall 21 mounting a fixed flame tube 30 which will be described in more detail hereinafter, a base wall 22 (see FIG. 4) having an ash discharge opening 23 (see FIG. 5) into the wood pellet boiler, a cranked rear wall 24 having a scraper discharge outlet 25 spaced apart from and above the base wall 22 and finally a pair of sidewalls 26. The fixed flame tube 30 provides a combustion gas outlet, indicated generally by the arrow 27, into the wood pellet boiler.

Figure 2:
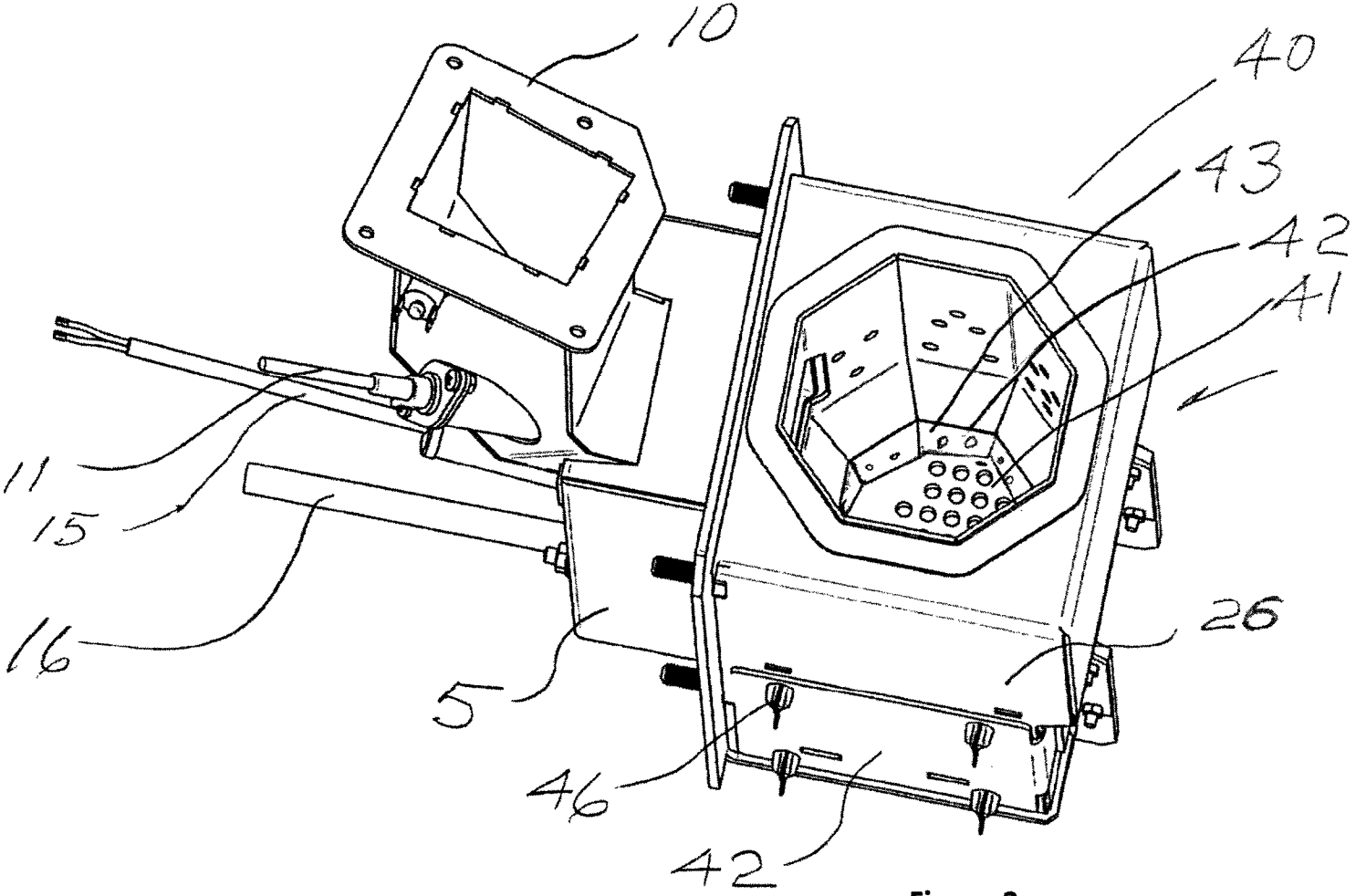
FIG. 2 is a perspective view from above of the wood pellet burner assembly.
Figure 3:
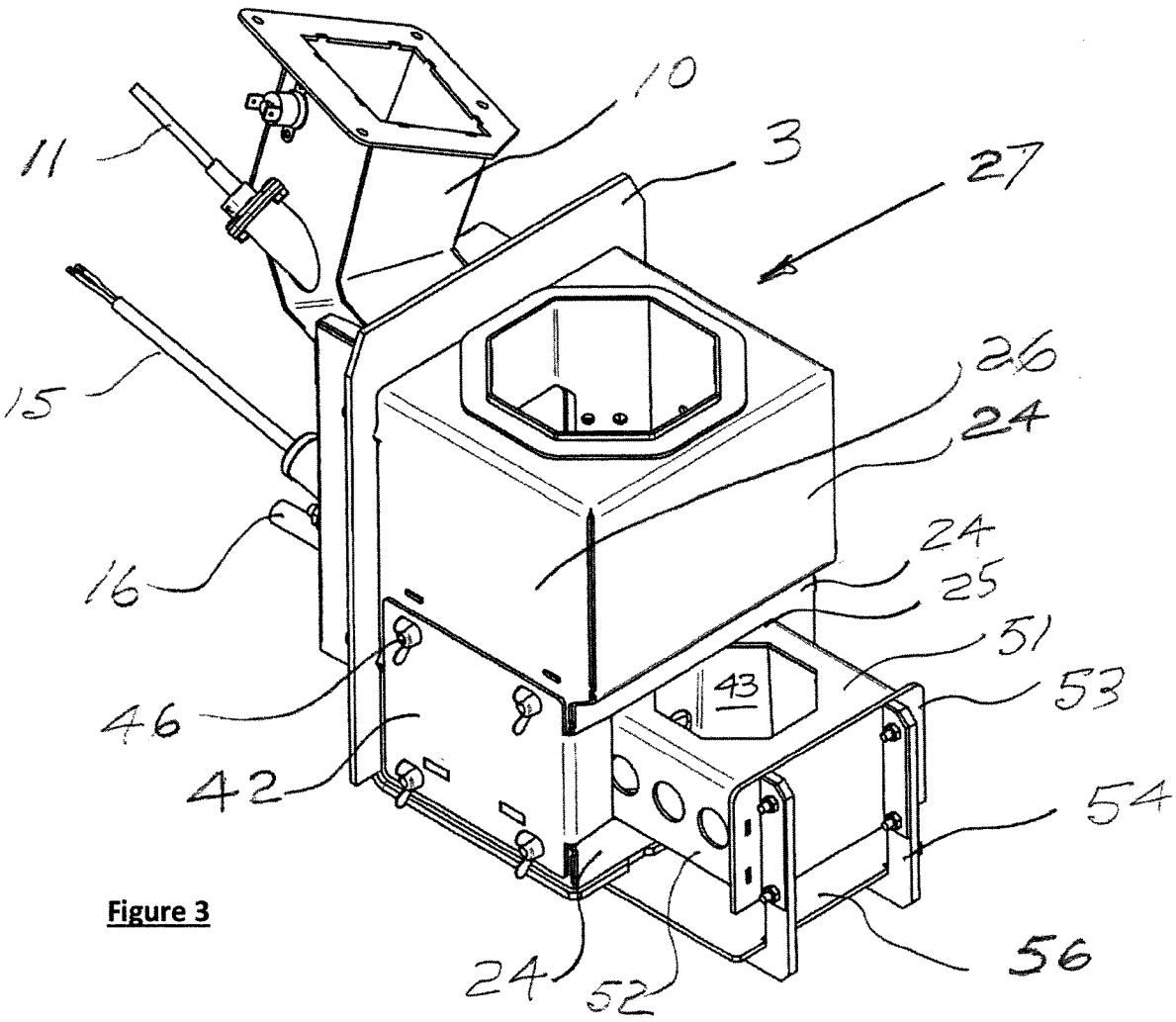
FIG. 3 is a rear perspective view of the wood pellet burner assembly in its cleaning position.
Figure 4:
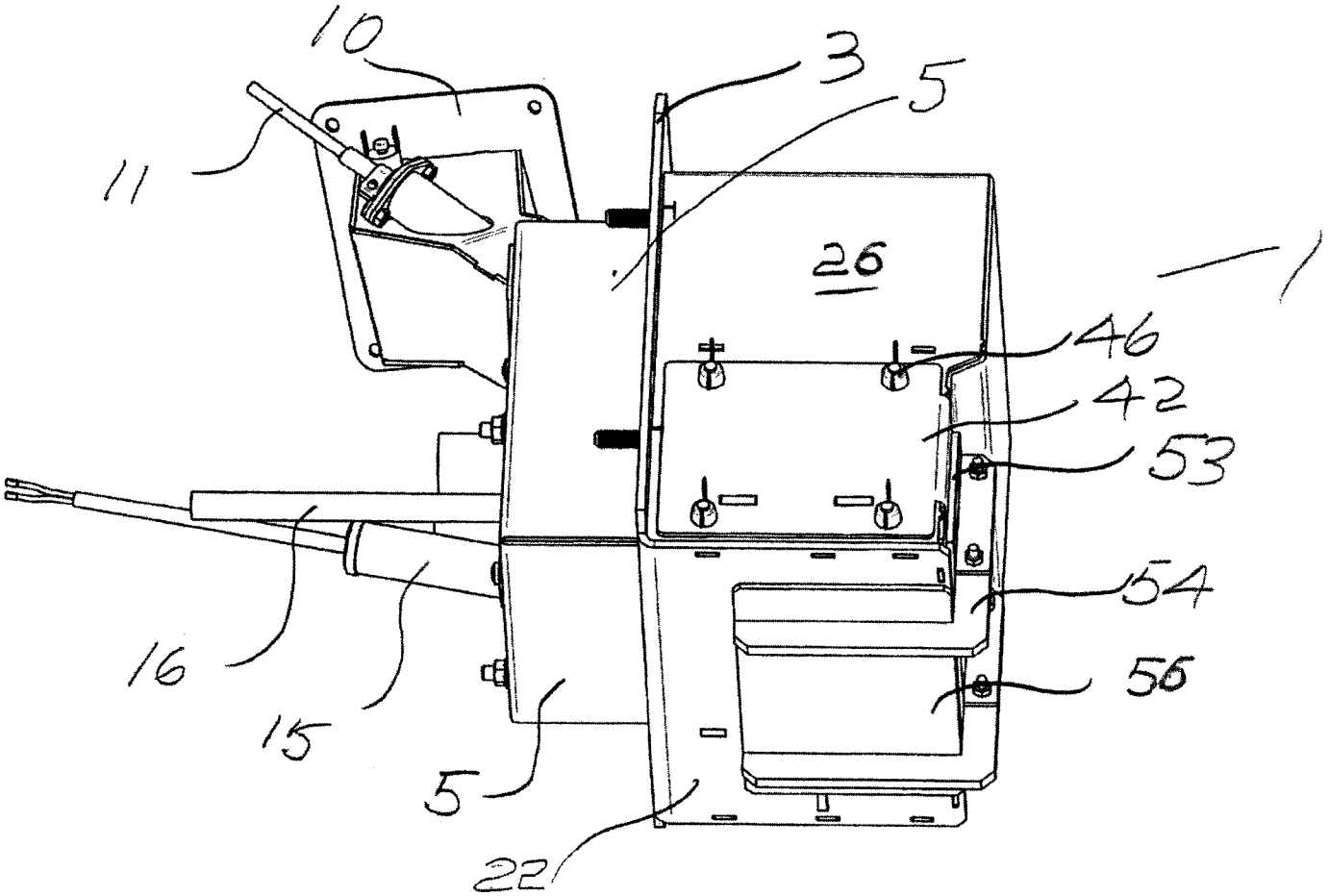
FIG. 4 is an underneath perspective view of the wood pellet burner assembly.
Figure 5:
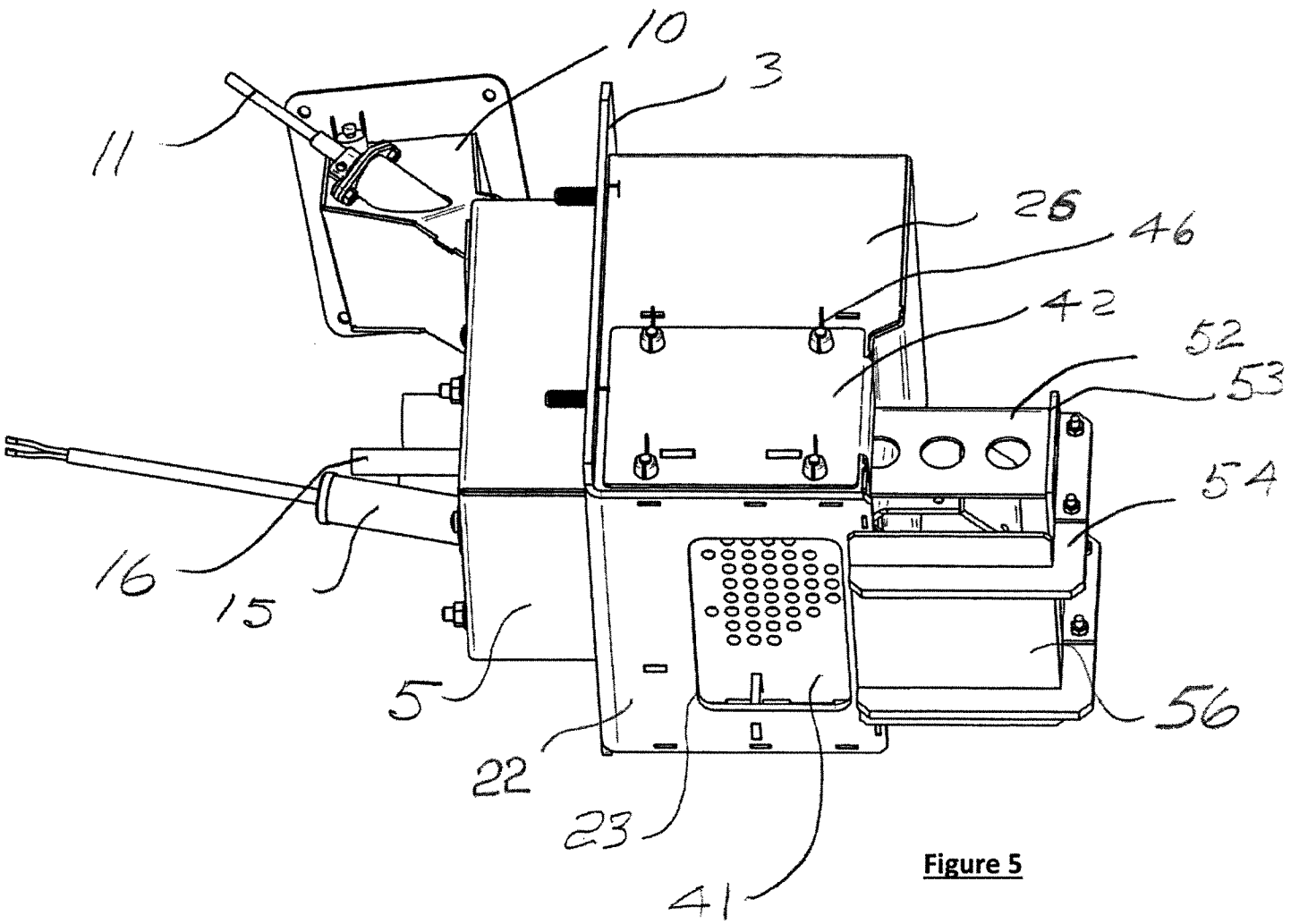
FIG. 5 is an underneath perspective view of the wood pellet burner assembly in its cleaning position, FIG. 6 it is a perspective exploded view of the wood pellet burner assembly.
Figure 6:
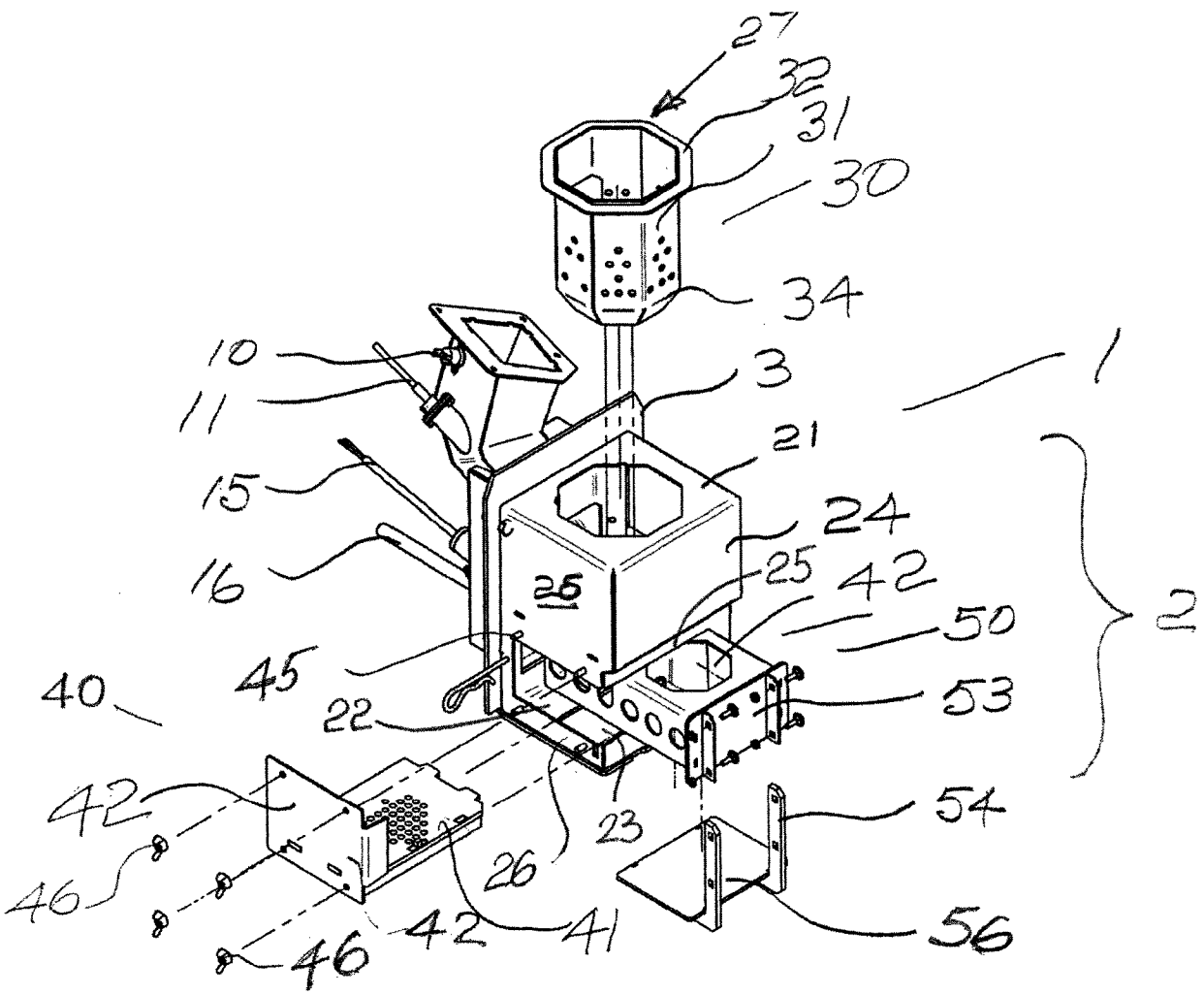

Referring particularly to FIG. 2 and FIG. 6 there is illustrated a brazier identified generally by the reference numeral 40 comprising a fuel supporting apertured grate, in this embodiment a fixed fuel supporting apertured grate 41 and a flame tube 42 having upstanding apertured sidewalls 43.

Figure 7:
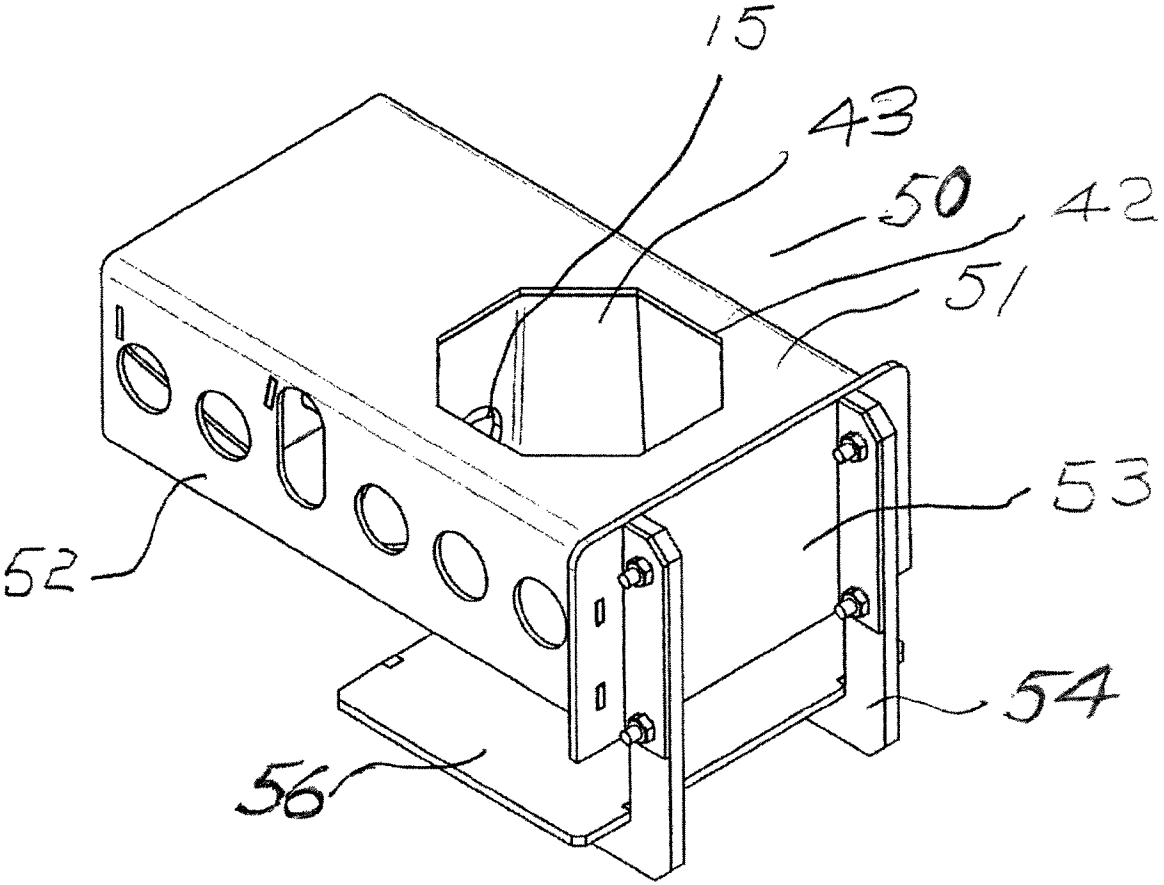
FIG. 7 is a perspective view from the rear of a movable scraper sub-assembly.
Figure 8:
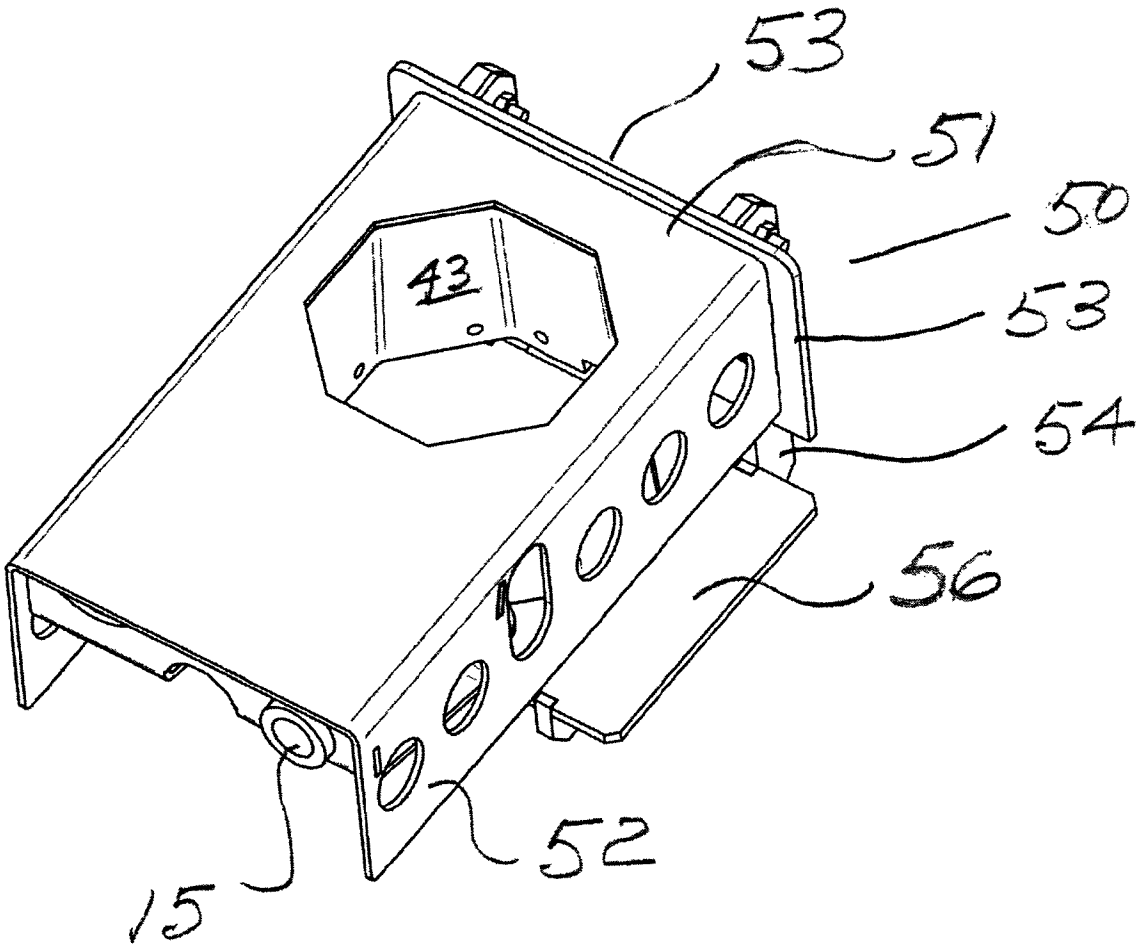
FIG. 8 is a front view of the movable scraper sub-assembly of FIG. 7.

Referring now specifically to FIGS. 7 and 8 there is provided a movable scraper sub-assembly identified generally by the reference numeral 50. The scraper sub-assembly 50 carries the flame tube 42. The scraper sub-assembly 50 comprises a top plate 51 from which the flame tube 42 depends bridging two apertured side plates 52 and an end closure plate 53. The end closure plate 53 acts as a closure door for the scraper discharge outlet 25 in the normal operating position. The end closure plate 53 carries by means of a pair of depending brackets 54 a closure door 56 in the form of a plate for the ash discharge opening 23. The scraper sub-assembly provides an actuator for the closure door 56 during a cleaning operation as will be described below.

Referring to FIG. 6 the fixed fuel supporting apertured grate 41 of the brazier 40 is mounted on one of the sidewalls by a support plate 42 threaded studs 45 and wing nuts 46. This allows for the easy removal of the brazier 40 for general cleaning or indeed for replacement in the unlikely event of damage or possibly excessive wear over many years use. Many other mounting arrangements could be chosen for ease of removal of the support plate 42.

Figure 9:
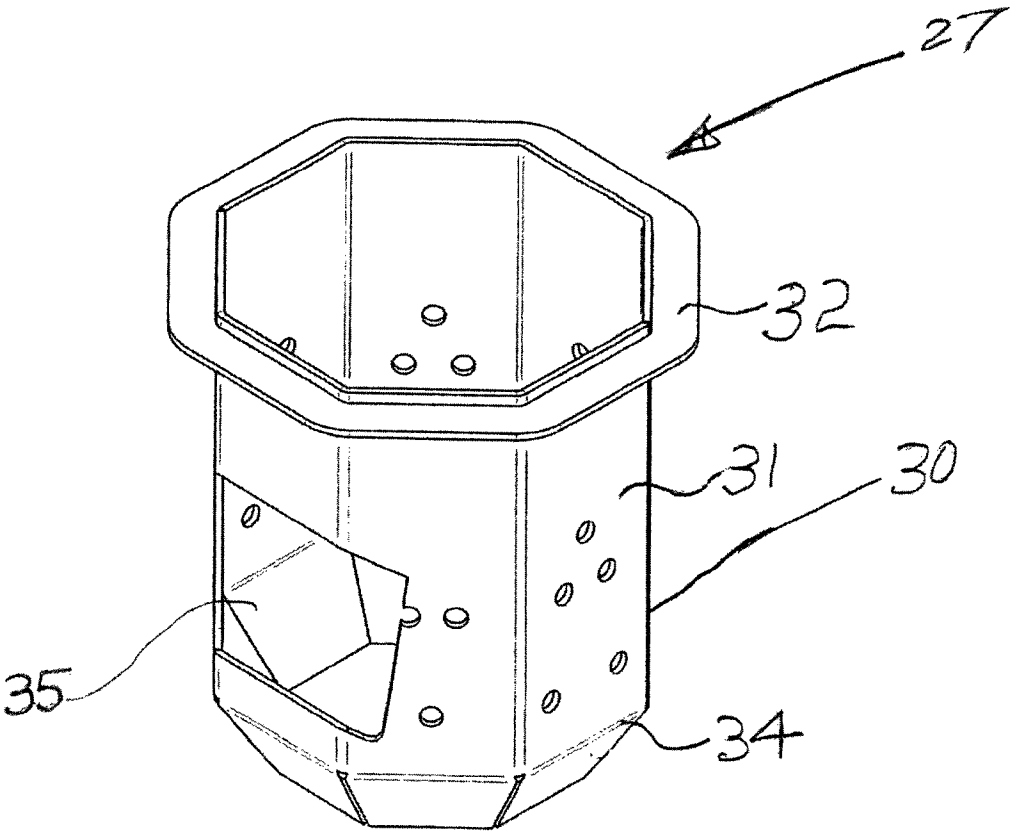
FIG. 9 is a perspective view of a fixed flame tube according to the invention.
Figure 10:
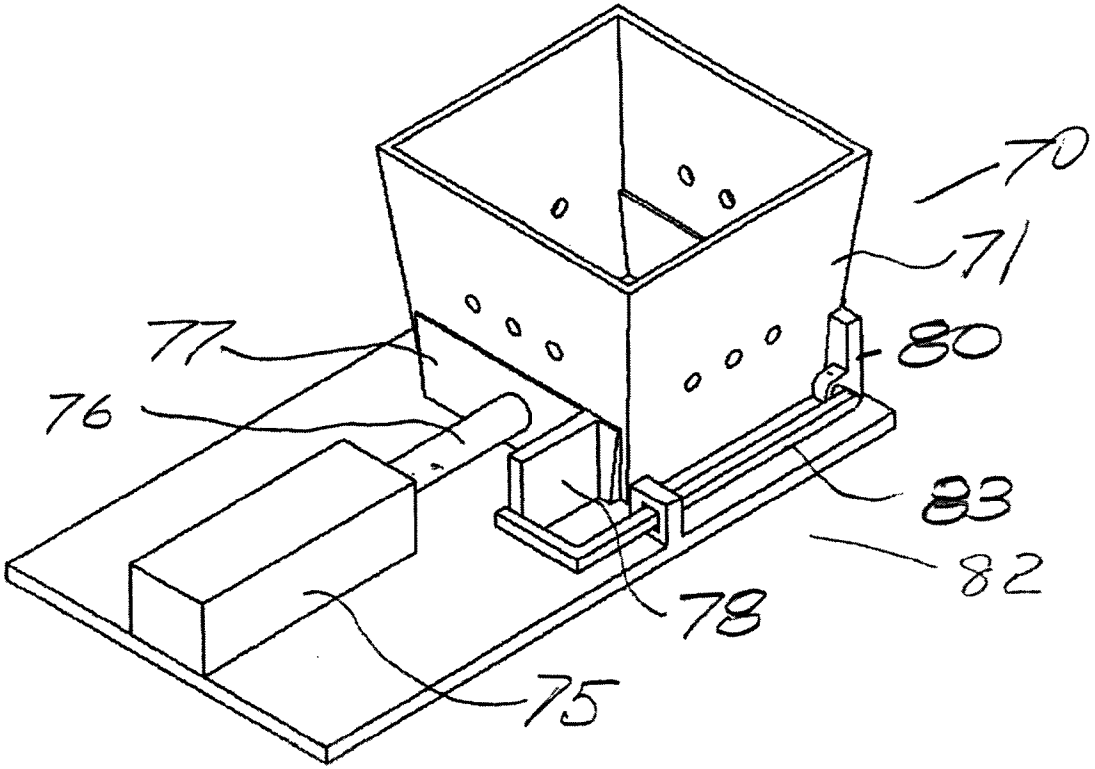
FIG. 10 is a diagrammatic front perspective view of an alternative construction of the movable scraper sub-assembly in the normal operating position as seen from the front.
Figure 11:
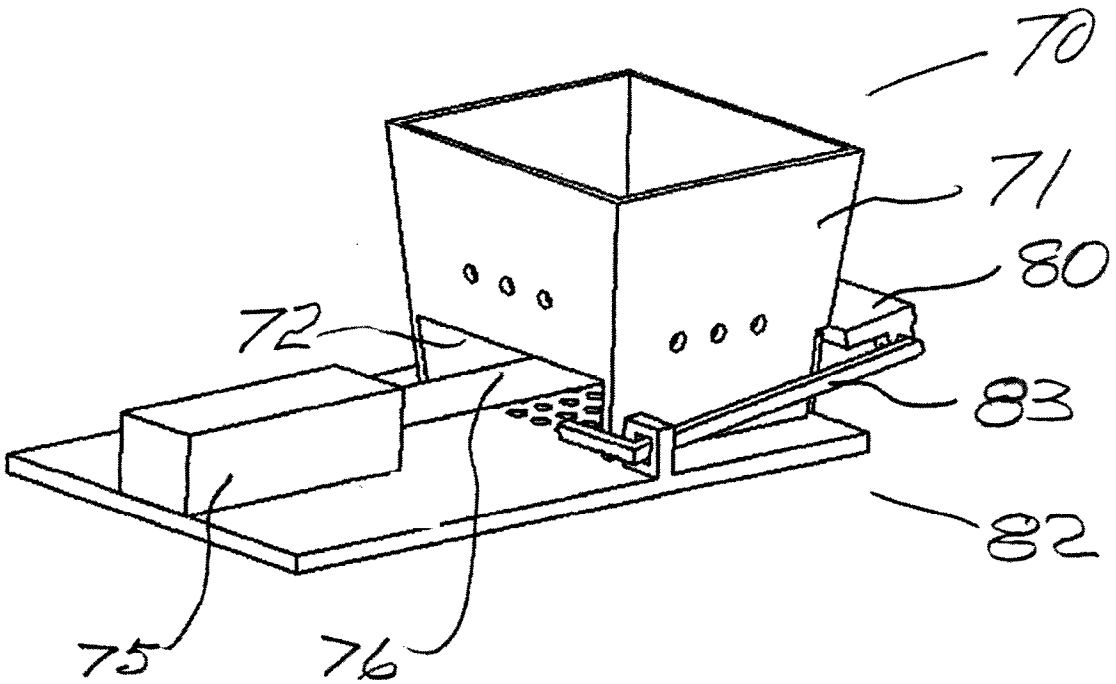
FIG. 11 is a diagrammatic front perspective view of the movable scraper sub-assembly of FIG. 10 in the cleaning position.
Figure 12:
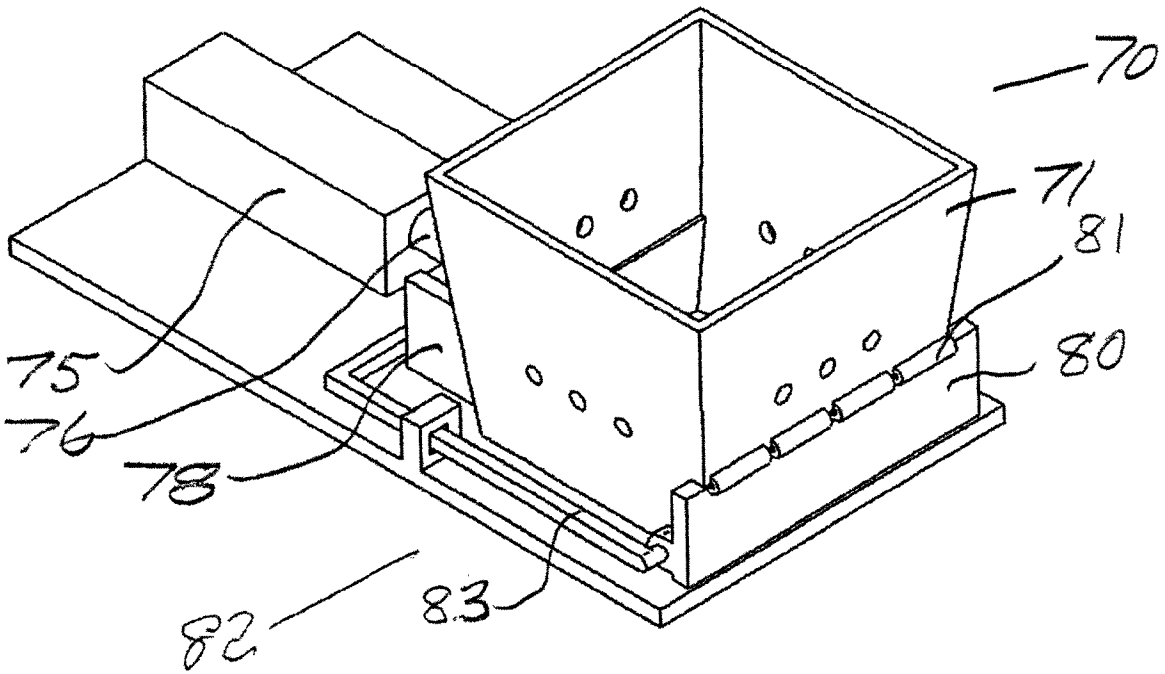
FIG. 12 is a diagrammatic rear perspective view of the movable scraper sub-assembly of FIG. 10 in the normal operating position as seen from the rear.
Figure 13:
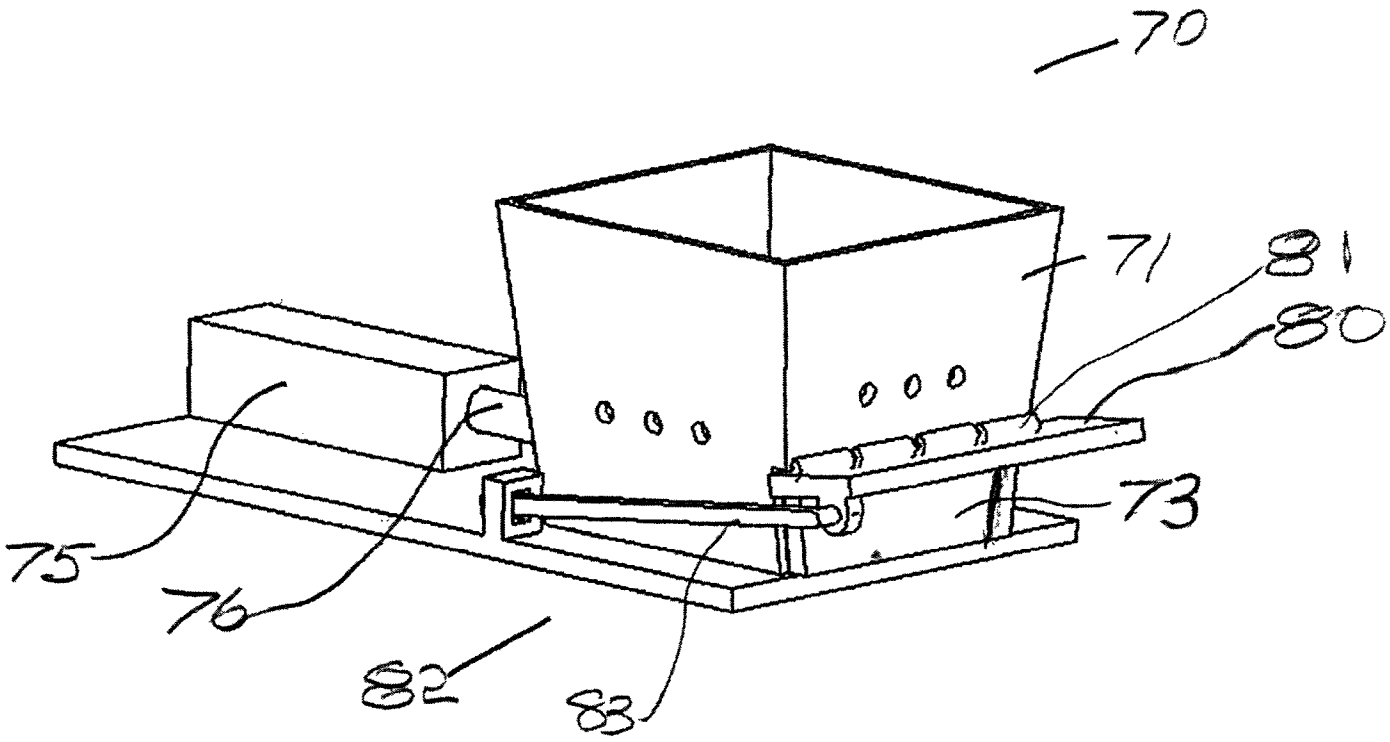
FIG. 13 is a diagrammatic rear perspective view of the movable scraper sub-assembly of FIG. 10 in the cleaning position.

Referring to FIG. 9 there is illustrated the fixed flame tube 30 which comprises straight apertured sidewalls 31 depending from a mounting rim 32 and tapered inwardly at 34 to engage above the flame tube 42 as can be seen in FIG. 2. The fixed flame tube 30 provides as mentioned already the combustion gas outlet 27 into the wood pellet boiler.

The main support enclosure 2 forms an enclosed air chamber with the only outlet for combustion gases during operation of the burner assembly 1 being the combustion gas outlet 27. The enclosed air chamber is separated into a pair of air chambers, a primary air chamber surrounding the flame tube 42 and a secondary air chamber surrounding the fixed flame tube 30. It will be noted from the drawings that the air chambers are separated by the top plate 51 of the scraper sub-assembly 50 and the only communication between the primary and secondary air chambers is where the flame tubes 42 and 30 meet.

In operation, the wood pellet burner assembly 1 operates in conventional manner. Then when it is desired to clean the burner assembly 1, the movable scraper sub-assembly 50 carrying the movable flame tube 42 is moved outwards through the scraper discharge outlet 25. The flame tube 42, acting as a conventional scraper, scrapes against the fixed fuel supporting apertured grate 41 capturing and pushing any ash and clinker before it and out the scraper discharge outlet 25. A considerable amount of the clinker and ash will still lie within the main support enclosure 2 having been delivered through the grate during the combustion cycles since previous cleaning and will be lying on the closure door 56. As the movable scraper sub-assembly 50 is moved, the discharge opening 23 is exposed and all the ash and clinker which will have gathered there during the operation of the wood pellet boiler being almost all of all the contents of combustion, will fall into the wood pellet boiler for subsequent removal. Usually this will be into an ash pan. It will be appreciated that as the closure door is being retracted ash and clinker falling out the discharge opening 23 will fall on to the closure door 56. Then as the movable scraper sub-assembly is retracted any clinker and ash on the closure door 56 will contact the rear wall 24 and be pushed sideways and out into the wood pellet boiler.

There is provided means for operating the cleaning cycle described above at clearly defined intervals depending on the amount of use of the boiler. The great advantage of regular cleaning cycles is that the build up of clinker should be minimal. In view of the fact that the grate can be easily removed it is envisaged that in many instances when removing the ashes and clinker from the boiler that the fixed grate will also be removed for cleaning.

While in the embodiment above all of the movable flame tube 42 has been described as movable it will be readily appreciated by those skilled in the art that it would be possible to have a lower portion of the flame tube 42 movable and the upper portion stationary.

Referring to FIGS. 10 to 13 inclusive there is provided an alternative construction of movable scraper sub-assembly, indicated generally by the reference numeral 70 in which parts similar to those described with reference to the previous drawings are identified by the same reference numeral. In this embodiment the remaining parts of the wood pellet burner assembly 1 are substantially the same as heretofore except for some minor differences as described below. There is provided a fixed flame tube 71 having a pair of spaced apart transfer apertures namely a proximal aperture 72 and a distal aperture 73 (see FIGS. 11 and 13 respectively). A linear actuator 75 is illustrated carrying a driveshaft 76 and a scraper blade 77 which forms a proximal aperture closure. A distal aperture closure 80 is pivotally mounted by a hinge 81 above the distal aperture 73. The distal aperture closure 80 is connected by a link mechanism indicated generally by the reference numeral 82 comprising link arm 83 and a rearwardly directed pusher arm 78 on the scraper blade 77.

In a cleaning operation the scraper blade 77 is pushed through the proximal aperture 72 and scrapes across the fixed fuel supporting apertured grate and against the distal aperture closure 80 raising it. The scraper blade 77 does not pass beyond the distal aperture closure 80. When the scraper blade 77 reverses its movement the link mechanism 82 comes into operation. The pusher arm 78 engages the link arm 83 and pulls it rearwardly so as to cause the distal aperture closure 80 to close in a positive manner.

It will be appreciated that many other modifications of this embodiment of the invention described with reference to FIGS. 10 to 13 inclusive could be provided, such as, for example, providing separate distal and proximal aperture closures and different ways of closing the said distal and proximal aperture closures.

Figure 14:
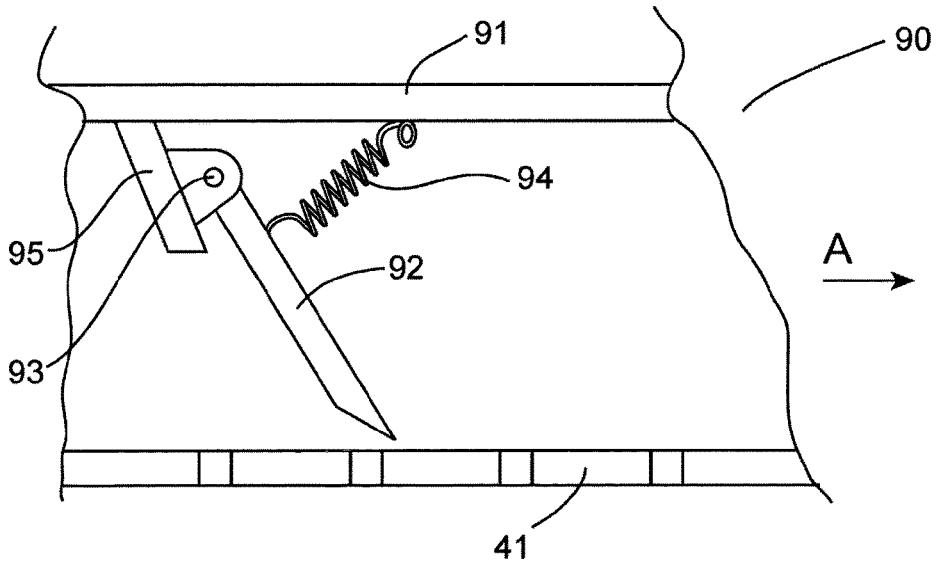
FIG. 14 is a diagrammatic side view of an auxiliary scraping device according to the invention and FIG. 15 is a diagrammatic side view of a further auxiliary scraping device according to the invention.

Referring now to FIG. 14 there is illustrated an additional auxiliary scraping device indicated generally by the reference numeral 90 for mounting by means of a support bar 91 on a movable scraper sub-assembly such as for example the movable scraper sub-assemblies 50 and 70 as described already. The auxiliary scraping device 90 comprises a scraper blade 92 mounted by a pivot pin 93 on the support bar 91 and urged by a spring 94 against a stop 95.

During a cleaning operation the auxiliary scraping device 90 is moved in the direction of the arrow A causing a further scraping action. On the return stroke it would simply be pushed out of the way.

Figure 15:
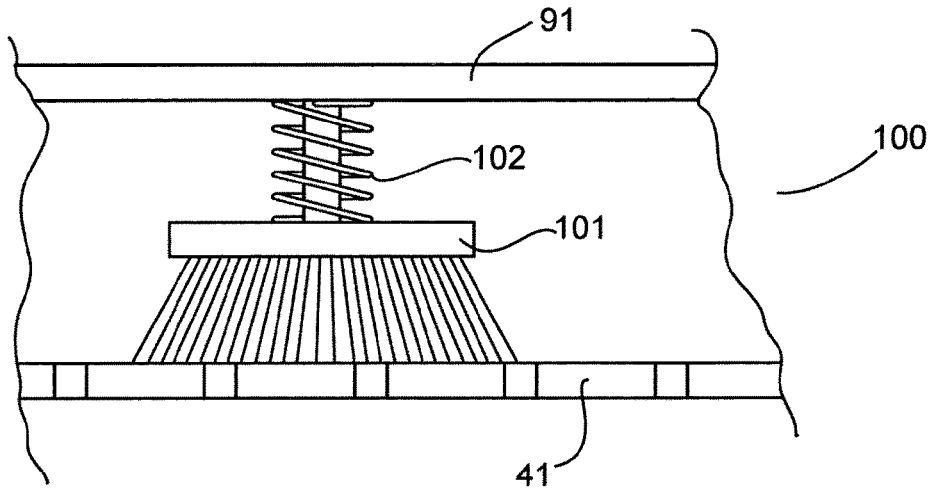

Referring to FIG. 15 there is illustrated a still further auxiliary scraping device indicated generally by the reference numeral 100, in which parts similar to those described with reference to the previous FIG. 14 are identified by the same reference numerals. This auxiliary scraping device 100 is a brush 101 which during a cleaning operation will be urged downwards by a spring 102.

In this specification the terms "comprise" and "include" and any necessary grammatical variations thereof are used interchangeably and are to be accorded the widest possible interpretation.

The invention is not limited to the embodiments described herein may be varied in both construction and detail within the scope of the appended claims.

The invention claimed is:

1. A wood pellet burner assembly for a wood pellet boiler, the wood pellet burner assembly being of the type comprising:

a main support enclosure for the wood pellet burner assembly and for mounting the wood pellet burner assembly within the wood pellet boiler, the main support enclosure providing an enclosed air chamber fed with combustion air from a burner fan and having a combustion gas outlet into the wood pellet boiler; and a brazier for reception of wood pellets and a fuel igniter, both being housed within the enclosed air chamber;

wherein the brazier and associated equipment comprises:

a fixed fuel supporting apertured grate mounted above and spaced apart from a base wall forming part of the main support enclosure; and a flame tube having upstanding apertured sidewalls; and in which there is further provided:

a movable scraper sub-assembly for traversing the fixed fuel supporting apertured grate for delivery of clinker and residual ash on the fixed fuel supporting apertured grate off the fixed fuel supporting apertured grate and out through a scraper discharge outlet in the enclosed air chamber during a cleaning operation, at least portion of the flame tube being movable across the fixed fuel supporting apertured grate to provide part of the movable scraper sub-assembly, and in which the base wall of the main support enclosure has an ash discharge opening beneath the fixed fuel supporting aperture grate, an ash discharge opening closure door for the ash discharge opening, said closure door being mounted on the movable scraper sub-assembly whereby on moving the movable scraper sub-assembly the closure door is opened.

2. A wood pellet burner assembly as claimed in claim 1 in which a lower portion of the flame tube is movable across the fixed fuel supporting apertured grate to provide part of the scraper sub-assembly.

3. A wood pellet burner assembly as claimed in claim 1 in which all the flame tube is movable across the fixed fuel supporting apertured grate to provide part of the scraper sub-assembly.

4. A wood pellet burner assembly as claimed in claim 1 in which the enclosed air chamber comprises two separate air chambers namely a primary air chamber and a secondary air chamber, containing respectively a movable flame tube and a fixed flame tube communicating with the movable flame tube.

5. A wood pellet burner assembly as claimed in claim 4 in which the movable scraper sub-assembly comprises a separate support framework including a top plate bridging two depending apertured side plates and an end closure plate for the primary air chamber, the movable flame tube depending from the top plate.

6. A wood pellet burner assembly as claimed in claim 1 in which:

a flame tube is fixed within the enclosed air chamber and carries a pair of spaced apart transfer apertures namely a proximal aperture and a distal aperture each being closed in operating conditions by respective proximal and distal closures; and in which the movable scraper sub-assembly comprises a transversely arranged scraper blade.

7. A wood pellet burner assembly as claimed in claim 6 in which the scraper blade forms the proximal aperture closure.

8. A wood pellet boiler assembly as claimed in claim 6 in which the distal aperture closure is formed by a pivotally mounted distal aperture closure on the flame tube.

9. A wood pellet boiler assembly as claimed in claim 8 in which the distal aperture closure is opened by the scraper blade and closed by a link mechanism connected to the scraper blade.

10. A wood pellet boiler assembly as claimed in claim 1 in which the movable scraper sub-assembly mounts an additional auxiliary scraping device in a position rearwardly outside the brazier with respect to its initial movement during the cleaning operation.

11. A wood pellet boiler assembly as claimed in claim 10 in which the auxiliary scraping device is a scraping blade.

12. A wood pellet boiler assembly as claimed in claim 11 in which the auxiliary scraping device is spring-loaded against the fixed fuel supporting apertured grate.

13. A wood pellet boiler assembly as claimed in claim 10 in which the auxiliary scraping device comprises a brush.

14. A wood pellet burner assembly as claimed in claim 1 in which the main support enclosure comprises:

a front wall for mounting on the exterior of the wood pellet boiler;

two sidewalls;

a top wall mounting a fixed flame tube;

the base wall;

a rear wall having the scraper discharge outlet spaced apart from and above the base wall through which the scraper sub-assembly moves, an end closure plate carrying a cover plate to provide the ash discharge closure door whereby upon a movable flame tube forming said at least portion of the flame tube progressing across the fixed fuel supporting apertured grate the ash discharge opening is exposed.

15. A wood pellet boiler assembly as claimed in claim 1 in which the fixed fuel supporting apertured grate is removably mounted on a sidewall of the main support enclosure.

* * * * *